US012778230B2

(12) United States Patent
Lenihan et al.

(10) Patent No.: US 12,778,230 B2
(45) Date of Patent: Nov. 3, 2026

(54) DYNAMICALLY AGGREGATED UPDATEABLE TWO-WAY DIGITAL ARTIFACT FOR CONTROLLING GARMENT MANUFACTURING

(71) Applicant: Resonance Companies LLC, New York, NY (US)

(72) Inventors: Lawrence Lenihan, New York, NY (US); Christian Gheorghe, New York, NY (US)

(73) Assignee: RESONANCE COMPANIES LLC, New York, NY (US)

( * ) Notice: Subject to any disclaimer, the term of this patent is extended or adjusted under 35 U.S.C. 154(b) by 0 days.

(21) Appl. No.: 18/967,751

(22) Filed: Dec. 4, 2024

(65) Prior Publication Data

US 2026/0150925 A1 Jun. 4, 2026

(51) Int. Cl.
*A41H 3/00* (2006.01)

(52) U.S. Cl.
CPC ..... *A41H 3/007* (2013.01)

(58) Field of Classification Search
CPC ..... A41H 3/007; A41H 2/00; A41H 42/00
USPC ..... 700/132, 130
See application file for complete search history.

(56) References Cited

U.S. PATENT DOCUMENTS 5,974,992 A * 11/1999 Asano ..... D05B 19/02 112/155
2005/0055255 A1* 3/2005 Soo ..... G06Q 10/06312 705/7.22
2014/0277683 A1* 9/2014 Gupta ..... G06F 30/00 700/132
2017/0258164 A1* 9/2017 Barnet ..... G06F 3/1208

* cited by examiner

*Primary Examiner* — Nathan E Durham
(74) *Attorney, Agent, or Firm* — CRGO Global; Steven M. Greenberg

(57) ABSTRACT

Dynamically aggregating an updateable digital artifact for controlling garment manufacturing includes receiving a body-material-color (BMC) specification for the manufacture of a garment, a selection of a base set of manufacturing parameters corresponding to the BMC specification and the generation of at least one data record associating a unique identifier for the garment with the base set of manufacturing parameters. For each corresponding process step in the manufacture of the garment, at least one data record is queried in order to retrieve only selected portions of the parameters associated with the corresponding process steps. Then, the selected portions are supplied to a garment processing apparatus for the corresponding process step, and observed metrics of the apparatus are read back during the corresponding process step. Finally, the observed metrics are stored in the data record in association with the unique identifier in supplement to the base set of manufacturing parameters.

15 Claims, 3 Drawing Sheets

DYNAMICALLY AGGREGATED UPDATEABLE TWO-WAY DIGITAL ARTIFACT FOR CONTROLLING GARMENT MANUFACTURING

BACKGROUND OF THE INVENTION

Field of the Invention

The present invention relates to the technical field of garment manufacturing and more particularly to the control and parameterization of different garment processing apparatuses in a garment manufacturing assembly line.

Description of the Related Art

The fashion industry is a major environmental challenge, responsible for approximately ten percent of global carbon emissions and nearly twenty percent of wastewater. Modern clothing production operates on a system of mass production and rapid consumption driven by the fast-fashion model. This has led to significant environmental impacts that demand attention and action.

This approach begins with the extraction and processing of raw materials, where natural fibers such as cotton require vast quantities of water, pesticides, and fertilizers. In contrast, synthetic fibers like polyester, derived from petroleum, contribute to fossil fuel depletion and greenhouse gas emissions. The fibers are then spun into yarns, woven or knitted into fabrics, and subjected to various chemical treatments to achieve desired colors, textures, and finishes. These processes consume significant amounts of energy and water and often involve hazardous chemicals that can harm workers and the environment.

The manufacturing phase of the fashion industry is also resource-intensive. Garment factories operate on a large scale to meet the demands of fast fashion brands that prioritize speed and low cost over sustainability. This results in high volumes of fabric waste, as large batches are cut from standard patterns with little regard for minimizing leftover material. Additionally, the processes of textile dyeing and finishing are particularly problematic, as they introduce toxic substances into water sources, contaminating local ecosystems.

The environmental impact of modern clothing production is profound. The textile dyeing and finishing stages generate pollution that contaminates water sources and ecosystems, while microplastics from synthetic fabrics shed during washing contribute to ocean pollution and pose threats to marine life. The energy-intensive nature of textile production further exacerbates climate change through substantial carbon emissions.

On the social side, the fast fashion model relies heavily on labor in developing countries, where workers often face poor conditions and low wages. The pressure to produce garments quickly and cheaply can lead to exploitative practices, including excessive working hours and unsafe working environments. These human costs are frequently hidden from consumers, who are often unaware of the true price of their inexpensive clothing.

Most shockingly, because of the nature of mass production caused by the fast-fashion model, the resulting production run of a particular garment satisfies the need and desire of only a small segment of the potential market. As a result. the vast majority of garments which are produced en masse for a very short sales cycle, ultimately, are never sold. These unsold garments invariably find themselves in landfills across the globe. Thus, the need for transformative change in the fashion industry is evident, demanding a shift towards sustainable and ethical practices to address its significant environmental and social impacts.

BRIEF SUMMARY OF THE INVENTION

Embodiments of the present invention address technical deficiencies of the art in respect to the management of a garment manufacturing process. To that end, embodiments of the present invention provide for a novel and non-obvious method for dynamically aggregating an updateable digital artifact for controlling garment manufacturing. Embodiments of the present invention also provide for a novel and non-obvious computing device adapted to perform the foregoing method. Finally, embodiments of the present invention provide for a novel and non-obvious data processing system incorporating the foregoing device in order to perform the foregoing method.

In one embodiment of the invention, a method for dynamically aggregating an updateable digital artifact for controlling garment manufacturing includes the receipt of a body-material-color (BMC) specification for the manufacture of a garment, the selection of a base set of manufacturing parameters corresponding to the BMC specification and the generation of at least one data record associating a unique identifier for the garment with the base set of manufacturing parameters. The method additionally includes, for each corresponding one of a multiplicity of process steps in the manufacture of the garment, a querying of at least one data record to retrieve only selected portions of the parameters associated with the corresponding one of the multiplicity of process steps, the supply of the selected portions of the parameters to a garment processing apparatus for the corresponding one of the multiplicity of process steps, the reading back of observed metrics of the garment processing apparatus during the corresponding one of the multiplicity of process steps, and the storage of the observed metrics in the data record in association with the unique identifier in supplement to the base set of manufacturing parameters.

Aspects of the embodiment include the following specific variations which may be deployed alone or in combination with one or more others of the variations:

- The BMC specification additionally includes a specification of fit, experience and trim.
- The process steps include ink printing of a fabric material, pattern cutting from the ink printed fabric material into different patterns, and sewing the different patterns into the garment.
- The garment processing apparatus includes, in respect to the ink printing of the fabric material, an ink jet printer, in respect to the pattern cutting, a laser cutter, and in respect to the sewing, a sewing machine.

Finally, in yet another aspect of the embodiment, at least one data record additionally stores therein manufacturing cost data derived from the observed metrics and a sale price of the garment determined during generation of the at least one data record.

In another embodiment of the invention, a data processing system is adapted for the dynamic aggregating of an updateable digital artifact for the control of garment manufacturing. The system includes a host computing platform that has one or more computers, each with memory and one or processing units including one or more processing cores. The system also includes a digital artifact dynamic aggregation module. The module includes computer program instructions which are enabled while executing in the memory of at least one of the processing units of the host computing platform to perform the receipt of a BMC specification for the manufacture of a garment to select a base set of manufacturing parameters corresponding to the BMC specification and to generate at least one data record associating a unique identifier for the garment with the base set of manufacturing parameters.

Thereafter, for each corresponding process step in the manufacture of the garment, the program instructions are enabled to query the data record to retrieve only selected portions of the parameters associated with the corresponding one of the multiplicity of process steps, to supply the selected portions of the parameters to a garment processing apparatus for the corresponding process step, to read back observed metrics of the garment processing apparatus during the corresponding one of the multiplicity of process steps and to store the observed metrics in the at least one data record in association with the unique identifier in supplement to the base set of manufacturing parameters.

In this way, the technical deficiencies of modern clothing production and the system of mass production driven by the fast-fashion model are overcome owing to the ability of the updateable digital artifact to support unit of one manufacturing demonstrably meeting the precise needs of the target customer. In that the updateable digital artifact supports unit of one manufacturing, there is no need to overproduce a garment resulting in the social and environmental impacts of garment mass production.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Embodiments of the invention provide for the dynamic aggregation of an updateable digital artifact for controlling unit of one garment manufacturing. In accordance with an embodiment of the invention, a BMC specification is received in memory in connection with the manufacture of a single, e.g. unit-of-one, garment. In response to the receipt of the BMC specification, a unique identifier is assigned to the garment and a data store of base manufacturing parameters for corresponding manufacturing process nodes requisite to the manufacture of the garment are retrieved corresponding to the BMC specification. A digital artifact (Meta. ONE) is then generated as an aggregation of the base manufacturing parameters and in association with the unique identifier corresponding to the garment.

Subsequently, at each corresponding one of the manufacturing nodes leading to the completion of the fabrication of the garment, only those portions of the digital artifact (Meta. ONE) relating to the corresponding one of the manufacturing nodes are extracted from the digital artifact and provided to the corresponding one of the manufacturing nodes so as to properly configure the corresponding one of the manufacturing nodes with respect to the garment. During processing of the garment in the corresponding one of the manufacturing nodes, performance metrics observed by the corresponding one of the manufacturing nodes are collected and returned for inclusion in the aggregation of the digital artifact.

As such, the digital artifact (Meta. ONE) is reflective of the intent at the time of the BMC specification to produce the garment, the actual performance of the manufacturing nodes during the production of the garment, and the resultant unit-of-one garment, obviating the need for a mass production of garments solely to meet the market needs of a minority of prospective consumers.

Figure 1:
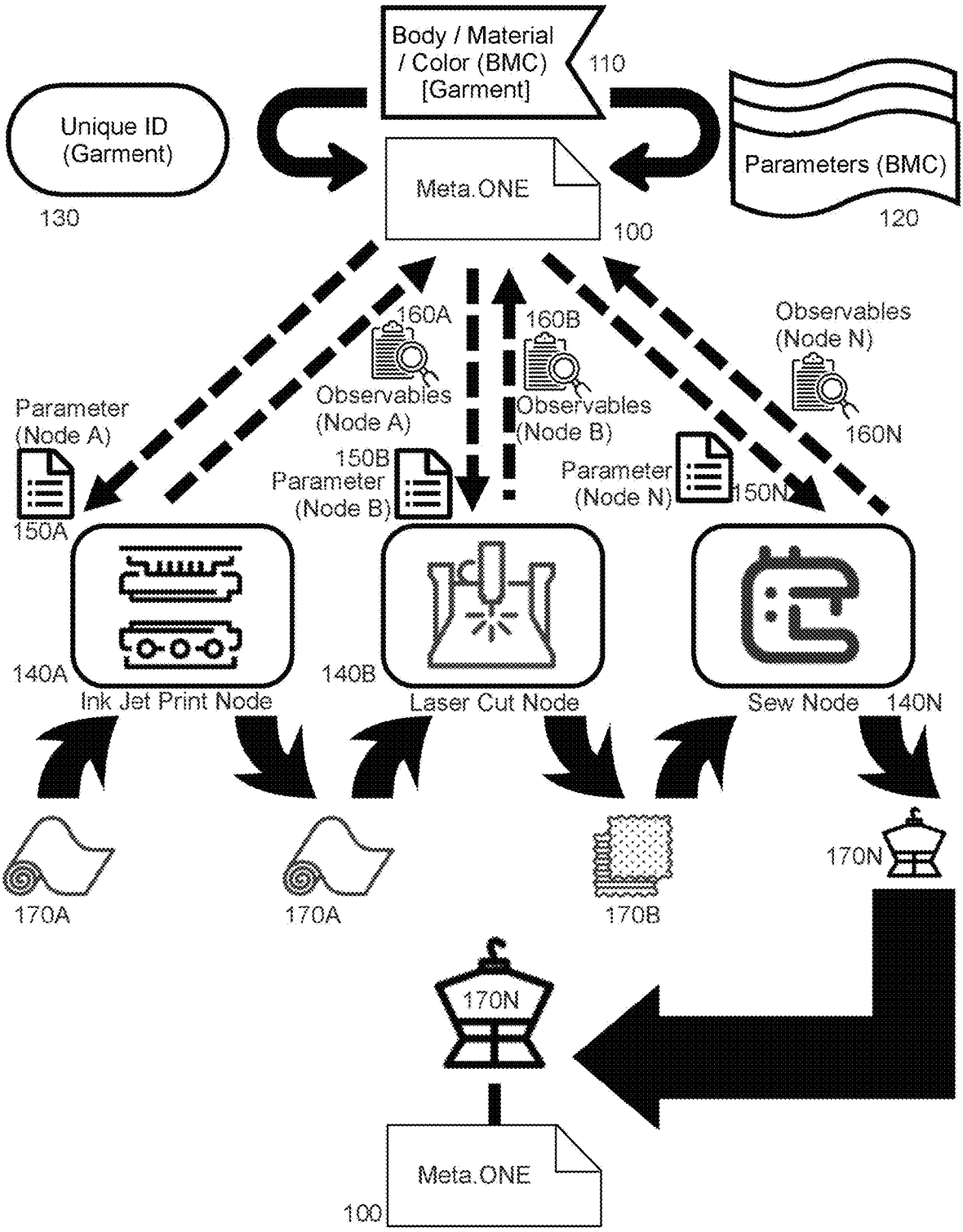
FIG. 1 is a pictorial illustration reflecting different aspects of a process of dynamically aggregating an updateable digital artifact for controlling garment manufacturing.

In illustration of one aspect of the embodiment, FIG. 1 pictorially shows a process of dynamically aggregating an updateable digital artifact for controlling garment manufacturing. As shown in FIG. 1, a BMC specification 110 is received specifying the body, material and color of a specified garment designated for unit-of-one manufacturing, and optionally a specification of fit, experience and trim. Thereafter, different base manufacturing parameters 120 are retrieved in connection with the BMC specification 110, for instance by querying a table correlating different manufacturing parameters 120 for different manufacturing processes with different BMC specifications. As well, a unique identifier 130 is assigned to the specified garment. Finally, an updateable digital artifact 100 (Meta.ONE) is created aggregating the different manufacturing parameters 120 with the unique identifier 130.

Subsequently, as different pre-cursors and finished components 170A, 170B, 170N of the garment are processed in different manufacturing nodes 140A, 140B, 140N of the manufacturing process, for instance a print node 140A, a laser cutting node 140B and a sew node 140N, the industrial machinery at a respective one of the nodes 140A, 140B, 140N queries the updateable digital artifact 100 for ones of the manufacturing parameters 120 pertaining only to the corresponding one of the nodes 140A, 140B, 140N. As well, during the course of processing the pre-cursors and finished components 170A, 170B, 170N, performance metrics are observed and returned for persistence within the updateable digital artifact 100 as nodal observables 160A, 160B, 160N. Further, optionally, the updateable digital artifact 100 stores therein manufacturing cost data derived from the nodal observables 160A, 160B, 160N along with a sale price of the finished component determined during generation of the updateable digital artifact 100.

In this way, as the updateable digital artifact 100 is presented with the finished component 170N—the garment—the updateable digital artifact 100 documents an assurance that the finished component 170N, a unit-of-one manufactured garment, is as specified at the outset in the BMC specification 110.

Figure 2:
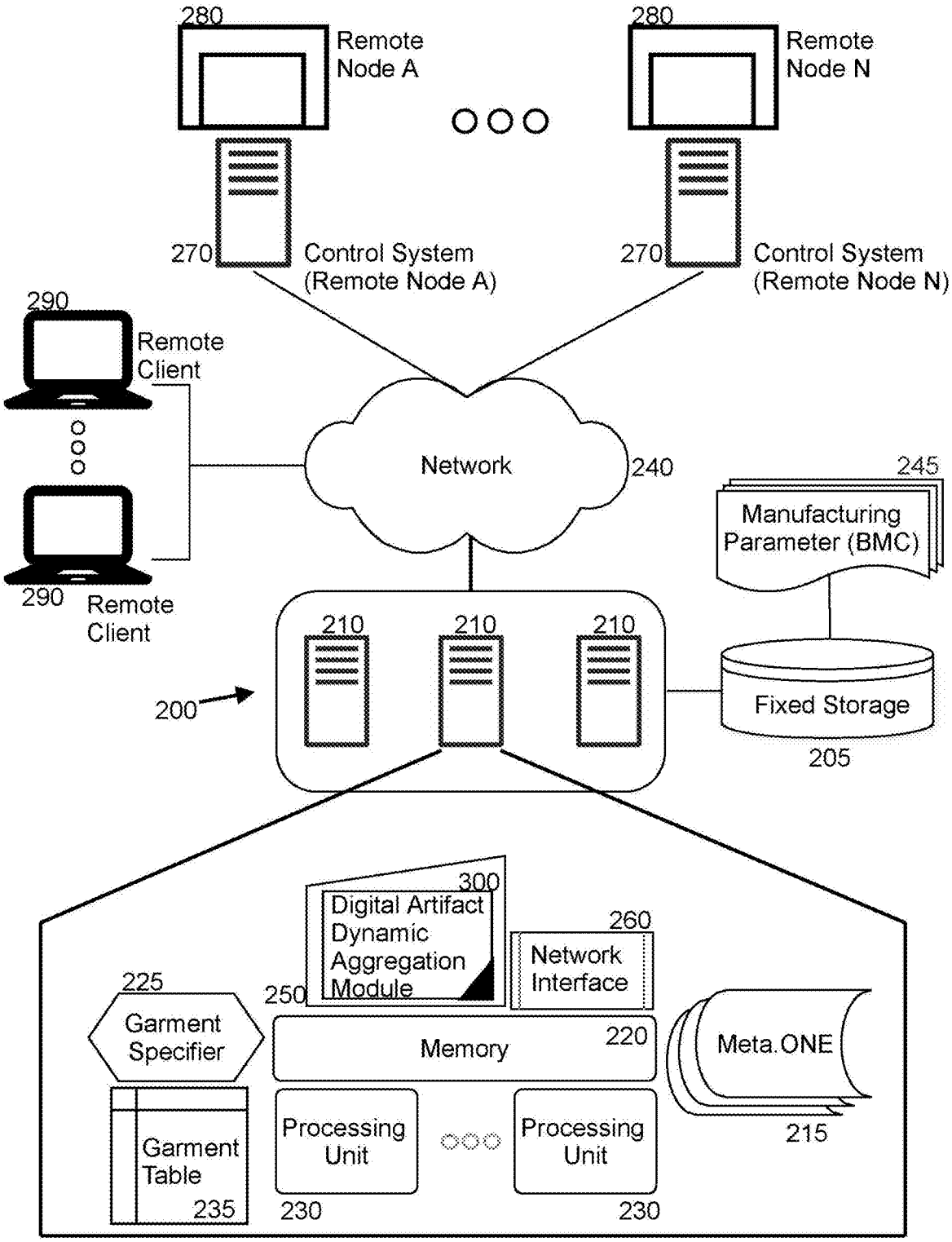
FIG. 2 is a block diagram depicting a data processing system adapted to perform one of the aspects of the process of FIG. 1; and, FIGS. 3A and 3B, taken together, are a flow chart illustrating one of the aspects of the process illustrated in FIG. 1.

Aspects of the process described in connection with FIG. 1 can be implemented within a data processing system. In further illustration, FIG. 2 schematically shows a data processing system adapted to perform dynamically aggregating an updateable digital artifact for controlling garment manufacturing. In the data processing system illustrated in FIG. 1, a host computing platform 200 is provided. The host computing platform 200 includes one or more computers 210, each with memory 220 and one or more processing units 230. The computers 210 of the host computing platform 200 (only a single computer shown for the purpose of illustrative simplicity) can be co-located within one another and in communication with one another over a local area network, or over a data communications bus, or the computers can be remotely disposed from one another and in communication with one another through network interface 260 over a data communications network 240.

The host computing platform 200 is communicatively coupled over the data communications network 240 to different control systems 270 for different remotely disposed manufacturing nodes 280 which in combination perform a manufacturing process for manufacturing a unit-of-one garment. By way of example, the nodes 280 can include ink-jet printing nodes adapted to ink-jet print color patterns on fabric, laser cutting nodes adapted to laser cut patterns from printed sheets of fabric, and sew nodes adapted to sew together the laser cut patterns into finished garments. Each of the control systems 270 apply configuration parameters to a corresponding ones of the nodes 280 in order to properly configure the nodes 280 to process the pre-cursors of a finished garment into the finished garment.

Notably, a computing device 250 including a non-transitory computer readable storage medium can be included with the host computing platform 200 and accessed by the processing units 230 of one or more of the computers 210. The computing device stores 250 thereon or retains therein a program module 300 that includes computer program instructions which when executed by one or more of the processing units 230, performs a programmatically executable process for dynamically aggregating an updateable digital artifact for controlling garment manufacturing. Specifically, the program instructions during execution received through a garment specifier user interface 225 accessed from over the data communications network by a remote client 290, a BMC specification for a unit-of-one manufactured garment.

In response, the program instructions assign a unique identifier to the BMC specified unit-of-one manufactured garment in a garment table 235 and the program instructions query one or more tables in fixed storage 205 with the BMC specification in order to retrieve manufacturing parameters 245 for each of the nodes 280 implicated in the process of fabricating the finished garment specified by the BMC specification. Thereafter, the program instructions generate an updateable digital artifact 215 aggregating each of the retrieved manufacturing parameters 245. Once the updateable digital artifact 215 is generated in the memory 220, the program instructions provide portions of the updateable digital artifact 215 to respective ones of the nodes 280 only to the extent that the portions pertain specifically to a respective one of the nodes 280 so that each of the nodes 280 is configured according to the manufacturing parameters 245 selected for the BMC specification.

Notably, as the precursors to the garment specified by the BMC specification are processed in a corresponding one of the nodes 280, the program instructions receive from the corresponding one of the nodes 280 from over the data communications network 240, performance metrics observed during the processing of the precursors. In each instance, the program instructions store the observed performance metrics in the updateable digital artifact 215 in association with the one of the nodes 280 in which the performance metrics had been observed. Consequently, the updateable digital artifact 215 not only controls the manner in which the nodes 280 process the pre-cursors into the garment, but also the updateable digital artifact 215 memorializes the unit-of-one manufacturing process from BMC specification to finished garment.

Figure 3A:
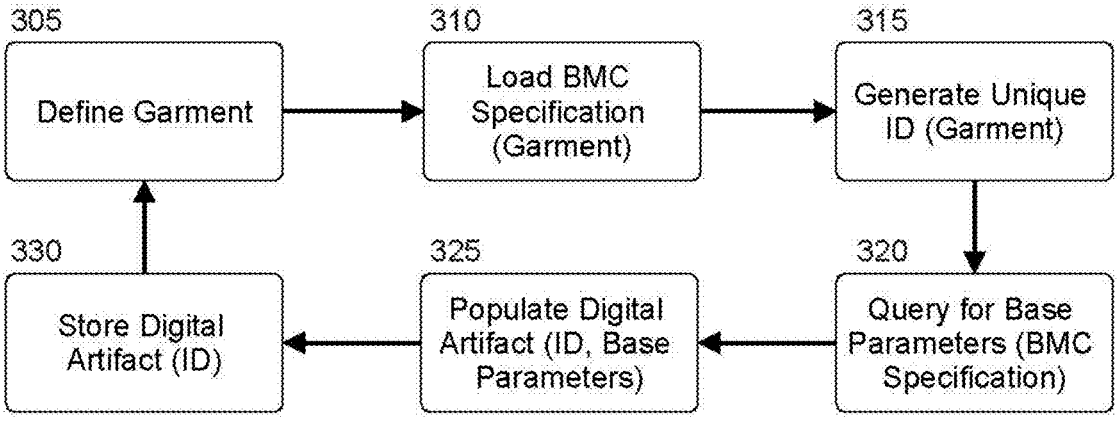
Figure 3B:
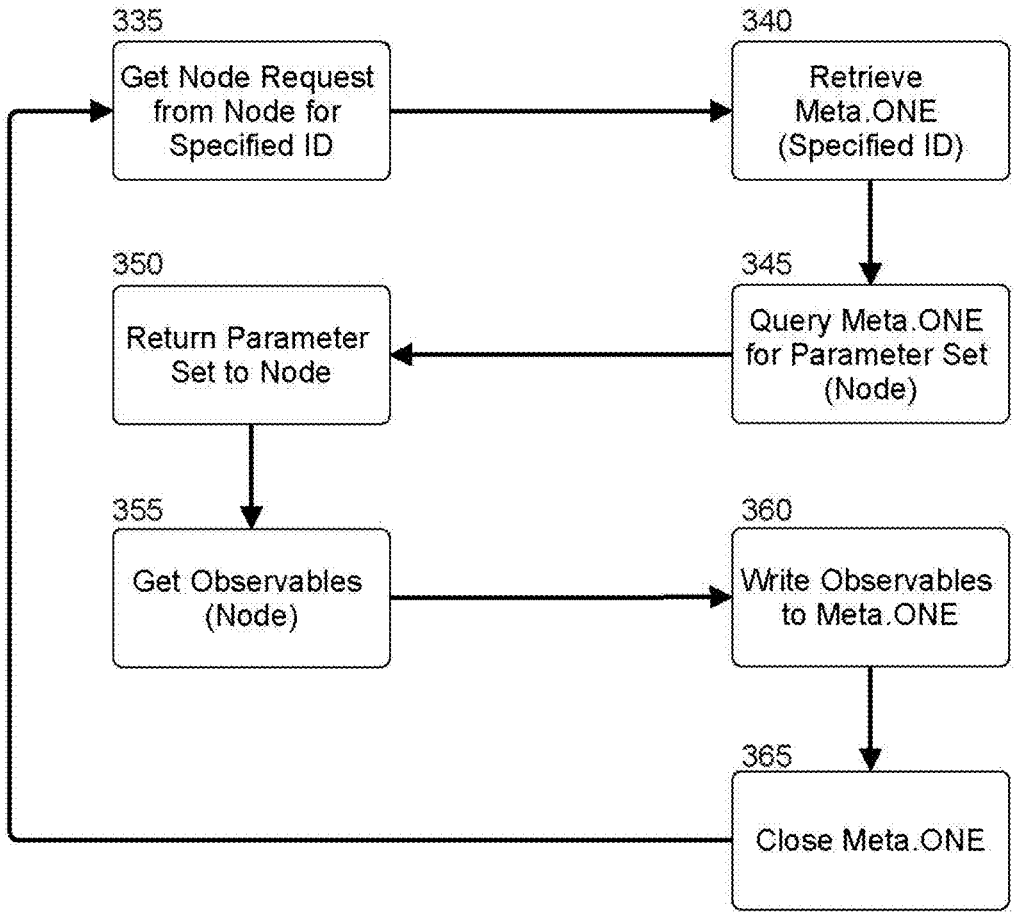

In further illustration of an exemplary operation of the module, FIGS. 3A and 3B, taken together, are a flow chart illustrating one of the aspects of the process of FIG. 1. Beginning in block 305, a unit-of-one garment is defined in memory and in block 310 a BMC specification is loaded for the unit-of-one garment. In block 315, a unique identifier is assigned to the unit-of-one garment and in block 320, a query is formulated with the BMC specification for submission to a data store of base parameters for configuring different manufacturing nodes of a garment manufacturing process. The base parameters upon receipt are then aggregated into an updateable digital artifact in block 325 and the updateable digital artifact is then stored in connection with the unique identifier.

Turning now to FIG. 3B, in block 335 a node request is received from one of the different manufacturing nodes including a specified identifier. In block 340, an updateable digital artifact having a unique identifier matching the specified identifier is then retrieved and opened for access, and in block 345, the updateable digital artifact is queried to retrieve a parameter set limited to only those base manufacturing parameters associated with the one of the different manufacturing nodes. The parameter set is then transmitted to the requesting node in block 350 so as to appropriately configure the one of the different manufacturing nodes for the unit-of-one manufacture of the garment associated with the updateable digital artifact.

In block 355, during the processing in the one of the different manufacturing nodes of the pre-cursor to the garment associated with the updateable digital artifact, performance metrics are collected including the environmental context of the processing of the pre-cursor in the one of the different manufacturing nodes, and quality control data acquired through remote optical sensing of the pre-cursor in the one of the different manufacturing nodes. Then, in block 360, the observed performance metrics are received from the one of the different manufacturing nodes and stored in the updateable digital artifacts in connection with the one of the different manufacturing nodes. Finally, in block 365 the updateable digital artifact is closed.

Of import, the foregoing flowchart and block diagram referred to herein illustrate the architecture, functionality, and operation of possible implementations of systems, methods, and computing devices according to various embodiments of the present invention. In this regard, each block in the flowchart or block diagrams may represent a module, segment, or portion of instructions, which includes one or more executable instructions for implementing the specified logical function or functions. In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

More specifically, the present invention may be embodied as a programmatically executable process. As well, the present invention may be embodied within a computing device upon which programmatic instructions are stored and from which the programmatic instructions are enabled to be loaded into memory of a data processing system and executed therefrom in order to perform the foregoing programmatically executable process. Even further, the present invention may be embodied within a data processing system adapted to load the programmatic instructions from a computing device and to then execute the programmatic instructions in order to perform the foregoing programmatically executable process.

To that end, the computing device is a non-transitory computer readable storage medium or media retaining therein or storing thereon computer readable program instructions. These instructions, when executed from memory by one or more processing units of a data processing system, cause the processing units to perform different programmatic processes exemplary of different aspects of the programmatically executable process. In this regard, the processing units each include an instruction execution device such as a central processing unit or "CPU" of a computer. One or more computers may be included within the data processing system. Of note, while the CPU can be a single core CPU, it will be understood that multiple CPU cores can operate within the CPU and in either instance, the instructions are directly loaded from memory into one or more of the cores of one or more of the CPUs for execution.

Aside from the direct loading of the instructions from memory for execution by one or more cores of a CPU or multiple CPUs, the computer readable program instructions described herein alternatively can be retrieved from over a computer communications network into the memory of a computer of the data processing system for execution therein. As well, only a portion of the program instructions may be retrieved into the memory from over the computer communications network, while other portions may be loaded from persistent storage of the computer. Even further, only a portion of the program instructions may execute by one or more processing cores of one or more CPUs of one of the computers of the data processing system, while other portions may cooperatively execute within a different computer of the data processing system that is either co-located with the computer or positioned remotely from the computer over the computer communications network with results of the computing by both computers shared therebetween.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows.

We claim:

1. A method for dynamically aggregating an updateable digital artifact for controlling garment manufacturing, the method comprising:

receiving a body-material-color (BMC) specification for the manufacture of a garment;

selecting a base set of manufacturing parameters corresponding to the body-material-color specification by querying a table correlating different ones of the manufacturing parameters for different manufacturing processes with different body-material-color specifications, and generating at least one data record associating a unique identifier for the garment with the base set of manufacturing parameters; and, for each corresponding one of a multiplicity of process steps in the manufacture of the garment, querying the at least one data record to retrieve only selected portions of the parameters associated with the corresponding one of the multiplicity of process steps, supplying the selected portions of the parameters to a garment processing apparatus for the corresponding one of the multiplicity of process steps, reading back observed metrics of the garment processing apparatus during the corresponding one of the multiplicity of process steps and storing the observed metrics in the at least one data record in association with the unique identifier in supplement to the base set of manufacturing parameters.

2. The method of claim 1, wherein the body-material-color specification additionally includes a specification of fit, experience and trim.

3. The method of claim 1, wherein the process steps include ink printing of a fabric material, pattern cutting from the ink printed fabric material into different patterns, and sewing the different patterns into the garment.

4. The method of claim 3, wherein the garment processing apparatus comprises:

in respect to the ink printing of the fabric material, an ink jet printer;

in respect to the pattern cutting, a laser cutter; and, in respect to the sewing, a sewing machine.

5. The method of claim 1, wherein the at least one data record additional stores therein manufacturing cost data derived from the observed metrics and a sale price of the garment determined during generation of the at least one data record.

6. A data processing system adapted for dynamically aggregating an updateable digital artifact for controlling garment manufacturing, the system comprising:

a host computing platform comprising one or more computers, each with memory and one or processing units including one or more processing cores; and, a digital artifact dynamic aggregation module comprising computer program instructions enabled while executing in the memory of at least one of the processing units of the host computing platform to perform:

receiving a body-material-color (BMC) specification for the manufacture of a garment;

select a base set of manufacturing parameters corresponding to the body-material-color specification by querying a table correlating different ones of the manufacturing parameters for different manufacturing processes with different body-material-color specifications, and generating at least one data record associating a unique identifier for the garment with the base set of manufacturing parameters; and, for each corresponding one of a multiplicity of process steps in the manufacture of the garment, querying the at least one data record to retrieve only selected portions of the parameters associated with the corresponding one of the multiplicity of process steps, supplying the selected portions of the parameters to a garment processing apparatus for the corresponding one of the multiplicity of process steps, reading back observed metrics of the garment processing apparatus during the corresponding one of the multiplicity of process steps and storing the observed metrics in the at least one data record in association with the unique identifier in supplement to the base set of manufacturing parameters.

7. The system of claim 6, wherein the body-material-color specification additionally includes a specification of fit, experience and trim.

8. The system of claim 6, wherein the process steps include ink printing of a fabric material, pattern cutting from the ink printed fabric material into different patterns, and sewing the different patterns into the garment.

9. The system of claim 8, wherein the garment processing apparatus comprises:

in respect to the ink printing of the fabric material, an ink jet printer;

in respect to the pattern cutting, a laser cutter; and, in respect to the sewing, a sewing machine.

10. The system of claim 6, wherein the at least one data record additional stores therein manufacturing cost data derived from the observed metrics and a sale price of the garment determined during generation of the at least one data record.

11. A computing device comprising a non-transitory computer readable storage medium having program instructions stored therein, the instructions being executable by at least one processing core of a processing unit to cause the processing unit to perform dynamic aggregation of an updateable digital artifact for controlling garment manufacturing by:

receiving a body-material-color (BMC) specification for the manufacture of a garment;

selecting a base set of manufacturing parameters corresponding to the body-material-color specification by querying a table correlating different ones of the manufacturing parameters for different manufacturing processes with different BMC specifications, and generating at least one data record associating a unique identifier for the garment with the base set of manufacturing parameters; and, for each corresponding one of a multiplicity of process steps in the manufacture of the garment, querying the at least one data record to retrieve only selected portions of the parameters associated with the corresponding one of the multiplicity of process steps, supplying the selected portions of the parameters to a garment processing apparatus for the corresponding one of the multiplicity of process steps, reading back observed metrics of the garment processing apparatus during the corresponding one of the multiplicity of process steps and storing the observed metrics in the at least one data record in association with the unique identifier in supplement to the base set of manufacturing parameters.

12. The device of claim 11, wherein the body-material-color specification additionally includes a specification of fit, experience and trim.

13. The device of claim 11, wherein the process steps include ink printing of a fabric material, pattern cutting from the ink printed fabric material into different patterns, and sewing the different patterns into the garment.

14. The device of claim 13, wherein the garment processing apparatus comprises:

in respect to the ink printing of the fabric material, an ink jet printer;

in respect to the pattern cutting, a laser cutter; and, in respect to the sewing, a sewing machine.

15. The device of claim 11, wherein the at least one data record additional stores therein manufacturing cost data derived from the observed metrics and a sale price of the garment determined during generation of the at least one data record.

* * * * *